United States Patent [19]

Wilson

[11] 4,021,112

[45] May 3, 1977

[54] PHOTORECEPTOR DARK CURRENT LEAKAGE DETECTING APPARATUS FOR XEROGRAPHIC MACHINES

[75] Inventor: Charles D. Wilson, Pittsford, N.Y.

[73] Assignee: Xerox Corporation, Stamford, Conn.

[22] Filed: June 23, 1975

[21] Appl. No.: 589,213

[52] U.S. Cl. ..... 355/14; 118/8; 118/658; 324/158 D; 355/3 DD; 355/3 R

[51] Int. Cl.[2] ..... G03G 15/00

[58] Field of Search ..... 355/14, 3 R, 3 CH, 3 DD, 355/17; 118/637, 7, 8; 324/158 D

[56] References Cited

UNITED STATES PATENTS

| | | | |
|---|---|---|---|
| 3,322,539 | 5/1967 | Redington | 355/17 X |
| 3,449,658 | 6/1969 | Robinson et al. | 324/32 |
| 3,654,893 | 4/1972 | Piper et al. | 118/8 X |
| 3,779,203 | 12/1973 | Altmann | 118/8 |
| 3,782,818 | 1/1974 | Smith | 355/3 R |
| 3,788,739 | 1/1974 | Coriale | 355/17 |
| 3,891,316 | 6/1975 | Whited | 355/3 DD |
| 3,918,395 | 11/1975 | Fearnside | 118/8 |
| 3,922,380 | 11/1975 | Rowell et al. | 355/3 DD |

*Primary Examiner*—Richard L. Moses

[57] ABSTRACT

A photoreceptor dark current leakage detecting device for use in determining the temperature induced current leakage of photoreceptors. The device as aforesaid comprises a miniature copy of, or segment from a photoreceptor class with electrical leads attached thereto and by means of which a reference bias can be applied thereacross. A current sensing meter introduced in circuit with the device measures current leakage. In a second embodiment, output from the device controls the operating bias on one or more of the components of an electrostatic reproduction machine to compensate for changes in photoreceptor current leakage.

5 Claims, 6 Drawing Figures

PHOTORECEPTOR DARK CURRENT LEAKAGE DETECTING APPARATUS FOR XEROGRAPHIC MACHINES

This invention relates to a method and apparatus for determining photoreceptor temperature sensitivity, and more particularly, to a method and apparaturs for detecting temperature induced changes in photoreceptor dark current leakage.

Photosensitive materials such as selenium of the type used in electrostatic type, i.e. xerographic, copying or reproduction machines often exhibit sensitivity to changes in temperature. This sensitivity, the nature and extent of which is often related not only to the specific materials used in the formation of the machine photoreceptor but also the type and manner in which the materials are processed and the additives used, may take the xerographic copying process unpredictable with resultant poor or unacceptable copy quality.

The aforesaid sensitivity is oftent manifested by increased dark current leakage through the photoreceptor, that is, current generated by leakage of the charges from the photosensitive surface to the conductive substrate. Such current leakage generally exhibits an expotential increase with increasing temperature. Since operating temperature increases often occur during machine operation, photoreceptors that exhibit undue sensitivity to temperature change may result in unpredictable machine operation.

It is therefore a principal object of the present invention to provide a new and improved xerographic reproduction machine.

It is a further object of the present invention to provide an improved apparatus for monitoring photoreceptor dark current leakage.

It is an object of the present invention to provide an improved method and apparatus for determining the current leakage characteristics of photoreceptors.

It is an object of the present invention to provide a test device representative of the photoreceptor construction for use in monitoring the temperature sensitivity of photoreceptors of the same class.

It is an object of the present invention to provide an arrangement designed to automatically compensate for temperature changes in the xerographic process of an electrostatic type copier.

This invention relates to a device for measuring the dark decay characteristics of a photoreceptor class adapted for use in xerographic copying machines. The device comprises a photoreceptor sandwich; the sandwich being comprised of an electrically conductive support, insulating layer, a photoconductive material, and a pair of electrical contacts or leads electrically coupled to the opposite sides of the sandwich to the conductive support and the photoconductive layer respectively to permit currents through the sandwich to be monitored. The conductive support, insulating layer, and photoconductive material are preferably comprised of the same materials as the substrate, insulator, and photosensitive materials comprising the photoreceptor class.

The invention further relates to a method for measuring dark decay of a class of photoreceptors adapted for use with xerographic copying apparatus, the steps consisting of constructing a test apparatus by removing a segment from at least one of the photoreceptors representative of the photoreceptor class and attaching electrical leads to each of the photosensitive surface and substrate of the removed photoreceptor segment; placing the test apparatus in an environment representative of the normal photoreceptor operating environment; placing a preset test voltage across the diode leads; and measuring current leakage through the diode for different temperature conditions to determine dark decay characteristics of the photoreceptor class.

Other objects and advantages will be apparent from the ensuring description and drawings in which.

Figure 1:
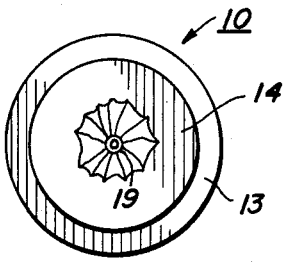
FIG. 1 is a top plane view of the photoreceptor dark current leakage detecting apparatus of the present invention.
Figure 2:
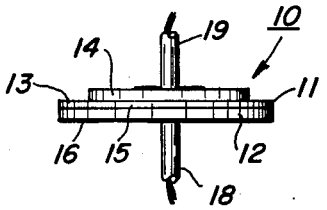
FIG. 2 is a side cross sectional view of the apparatus shown in FIG. 1.
Figure 3:
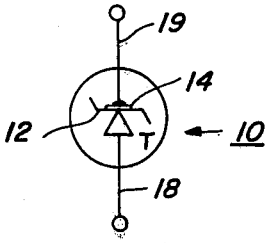
FIG. 3 is an electrical schematic representative of the leakage detecting apparatus of the present invention.

Referring to FIGS. 1 – 3 of the drawings, the dark current leakage apparatus 10 of the present invention is there shown. Current leakage apparatus 10 comprises a photoreceptor sandwich 11 made up of a conductive base or substrate 12, and a layer 14 of photoconductive material, and a layer 15 of insulating material therebetween. Preferably, base 12 comprises a disc-like segment, approximately one inch in diameter, with insulating layer 15 covering one side of base 12. The opposite side 16 of base 12 is preferably bare, i.e. uncoated.

The photoconductive layer 14 is desposited, as by vacuum deposition for example, on the insulating layer 15. Preferably, a relatively small uncoated margin 13 is provided around the perimeter of the photoconductive layer to assure that no inadvertent electrical conductivity exists between base 12 and photoconductive layer 14. Uncoated margin 13 may be obtained by etching or abrading away a small portion of the photoconductive layer 14 about the perimeter thereof, or, by masking the margin area 13 before deposition of the photoconductive layer.

Base 12, insulating layer 15 and photoconductive layer 14 preferably comprise the same materials as the materials that made up the xerographic photoreceptor, or class of photoreceptors in the case of of plural photoreceptors, represented thereby. In one typical photoreceptor, base 12 is nickel, insulating layer 15 a dielectric film of polyurethane, and photoconductive layer 14 is selenium. Typical thicknesses are 0.006 inch for base 12, 1 micron for insulating layer 15, and 50 microns for photoconductive layer 14. One photoreceptor type may be found in U.S. Pat. No. 3,713,821 issued Jan. 30, 1973.

While the photoreceptor sandwich 11 may be fabricated independently, sandwich 11 may also comprise a segment taken from a photoreceptor or a representative photoreceptor from a photoreceptor production run, as by cutting or punching and finishing in the manner described.

Wire leads 18, 19 are conductively attached to base 12 and photoconductive layer 14 respectively to complete current leakage apparatus 10. Leads 18, 19 may be attached by any suitable means, i.e., by conductive epoxy type adhesive, spring contacts, evaporated contacts, and the like. Preferably, wire lead 19 is attached to photoconductive layer 14 to provide a relatively broad surface contact area. Point contact is normally sufficient between wire lead 18 and substrate 12.

Figure 4:
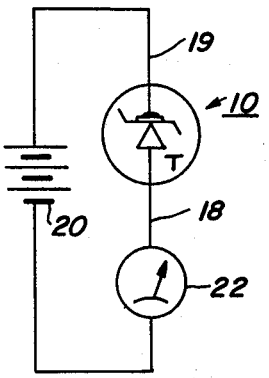
FIG. 4 is an electrical schematic of a photoreceptor current leakage detecting circuit employing the leakage detecting apparatus of the present invention.

In use, and referring particularly to FIG. 4, a suitable bias voltage is imposed across leads 18, 19. The bais voltage source may comprise any suitable direct current (d.c.) power supply represented in exemplary fashion in FIG. 4 by battery 20. A suitable current meter 22, preferably a nano or micro ampere meter is provided to measure current leakage from current leakage apparatus 10.

In conducting measurements, current leakage apparatus 10 is placed in the dark, and the current through the apparatus 10 is measured by meter 22. From this, the sensitivity of the photoreceptor or photoreceptor class represented by the apparatus 10 at any given temperature, may be calculated according to the following formula:

$$S_{T1} = I/A$$

where $S_{T1}$ is the photoreceptor sensitivity at temperature $T_1$

I is the current leakage through the apparatus 10, and

A is the area of photoconductive layer 14.

By varying the temperatures to which the apparatus 10 is exposed, the sensitivity (S) for the particular photoreceptor or photoreceptor class represented by the apparatus 10 to change in temperature can be obtained. From this, operation of the various components that cooperate to make up the xerographic system may be optimized to accommodate changes in photoreceptor performance due to changes in operating temperatures.

Figure 6:
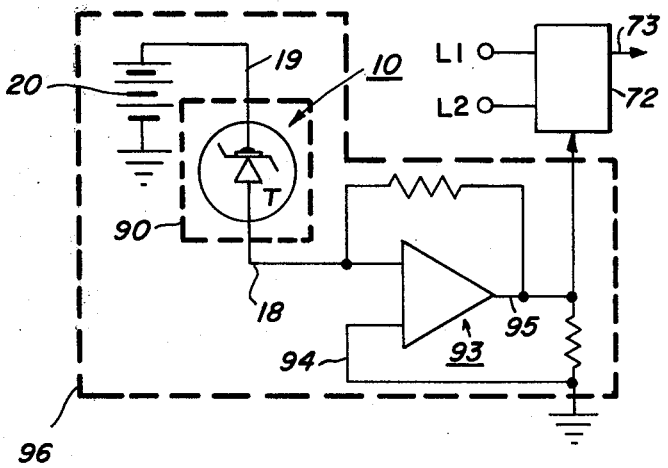
Figure 5:
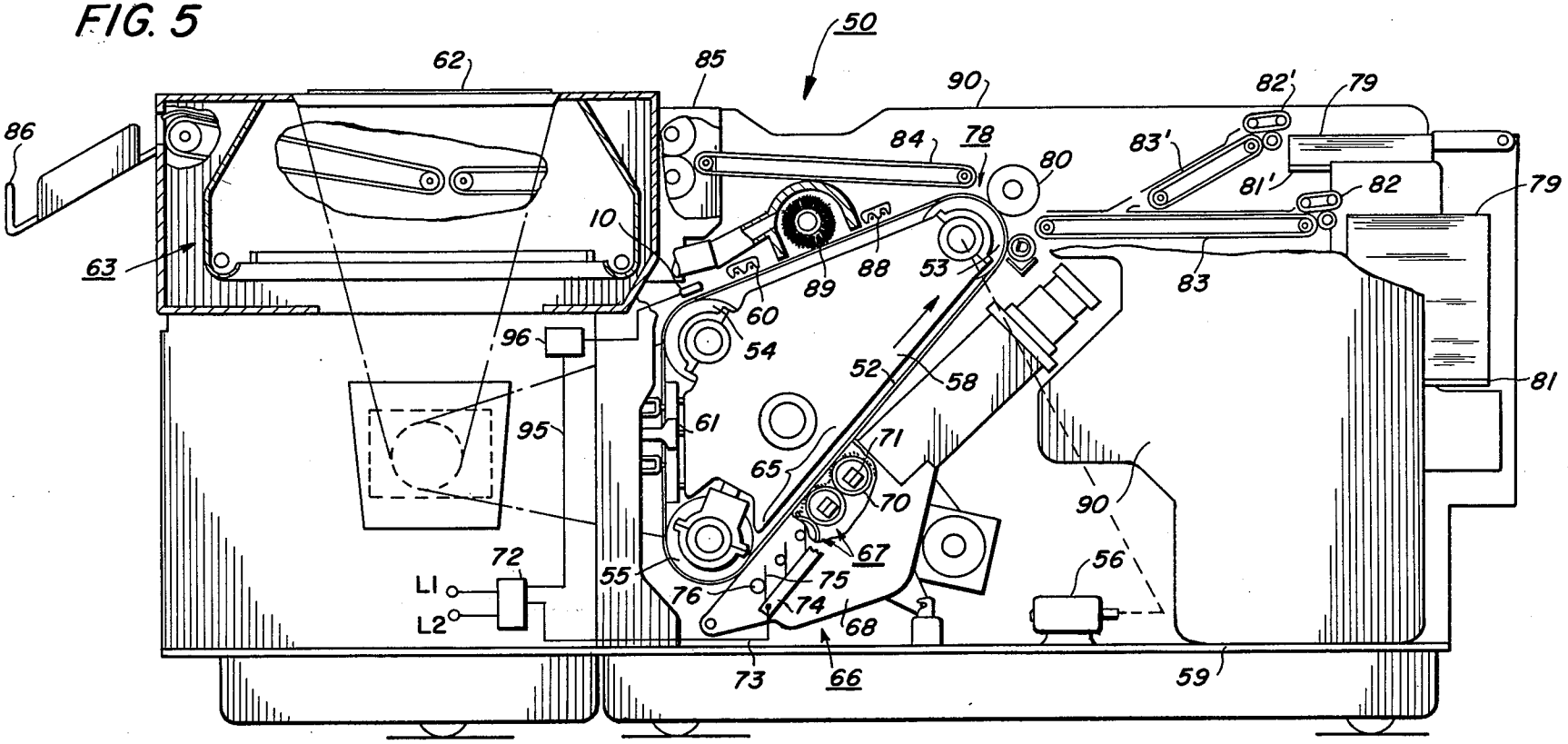
FIG. 5 is a schematic view of an exemplary xerographic machine incorporating the leakage detecting apparatus of the present invention; and, FIG. 6 is an electrical schematic of an alternate embodiment using the leakage detecting apparatus of FIG. 1 for feedback control in the machine shown in FIG. 5.

Referring now to the embodiment illustrated in FIGS. 5 and 6, there an exemplary xerographic copying or reproduction machine 50 is illustrated incorporating an automatic process control of the present invention. Referring thereto, reproduction machine 50 has a photoreceptor in the form of an endless web or belt 52. Belt 52 is supported for travel in an endless generally triangular path by rollers 53, 54 and 55. One or more of the belt supporting rollers 53, 54, 55 is drivingly coupled to a suitable motor 56 which drives belt 52 in the direction shown by the solid line arrow. Rollers 53, 54, 55 are rotatably journaled in a substantially triangular belt module 58 which in turn is releasably and operably mounted on main frame 59 of machine 50.

As will be understood by those skilled in the art, the surface of the moving belt 52 is charged by a suitable charging device, such as corotron 60 in preparation for imaging. The charged surface then moves through an exposure station 61 whereat the belt is exposed to a light image of the original 62 being copied as produced by an exposure mechanism 63. Exposure to light alters the electrostatic charge on the photosensitive belt 52 in conformance with the original 62 to produce a latent electrostatic image of original 62 on belt 52.

The latent electrostatic image produced on belt 52 is then carried past developing station 65 where the image is developed, i.e. rendered visible by developing apparatus 66. The developing apparatus 66 illustrated includes a plurality of magnetic brush developer rolls 67 which serve to bring electrically charged marking or toner particles from a suitable developer mixture in sump 68 into proximity with belt 52 and the latent image thereon. The electrostatic charges on belt 52 attract the toner particles onto the belt in imagewise configuration to provide a visible toner delineated image.

Each developer roll 67 includes a hollow rotatable sleeve 70 formed of conductive material, with one or more generally elongated magnets 71 disposed interiorly thereof. Sleeves 70, which rotate about magnets 71 and are journaled by suitable bearing means (not shown) for this purpose are biased to a preset voltage drawn from a suitable d.c. power source 72. leads $L_1$, $L_2$ couple power source 72 with a suitable source of electrical power. Lead 73 couples the output side of power source 72 with voltage distributor 74 which serves to conduct, through wipers 75 and sleeve journal shafts 76, voltage to the magnetic brush sleeves 70. Suitable insulating devices (not shown) are provided to prevent grounding of sleeves 70. A more detailed description of developing apparatus 67 and the biasing arrangement therefor may be found in copending application Ser. No. 225,721, filed May 22, 1972.

The belt 52 bearing the developed image thereafter passes through a transfer station 78 whereat the developed image is electrostatically transferred to a transfer material such as copy sheets 79. To facilitate the aforementioned transfer operation, a bias transfer roll 80 is provided.

Copy sheets 79 which are stored in supply tray 81 are brought forward to transfer station 78 by appropriate means such as conveyors 82, 83. An auxiliary supply of copy sheets 79, in the form of supply tray 8' may be provided. In that case, additional conveyors 82', 83' are provided to advance sheets from the auxiliary tray 81'.

Following transfer, each copy sheet 79, bearing the toner image, is carried by a conveyor 84 to a suitable fusing mechanism 85 where the toner image is permanently fixed to copy sheet 79. The finished copy sheet is thereafter transported to output tray 86.

Following transfer of the developed image therefrom, belt 52 is reconditioned in preparation for re-imaging. In accordance therewith, residual charges on belt 52 may be neutralized or reduced by means of preclean corotron 88 and thereafter the belt surface may be cleaned by a brush 89. Brush 89 is preferably housed in an evacuated chamber which serves to draw of particulate materal, normally toner, removed from the surface of belt 52 by brush 89.

To protect the various operating components of reproduction machine 50 from damage and the operator or user from harm, as well as to provide an asthetically appealing design, various exterior covers 90 are provided to enclose the machine structure.

In the embodiment represented by FIGS. 5 and 6, current leakage apparatus 10 is suitable disposed within the reproduction machine covers 90 in a normally dark area proximate photoreceptor belt 52. Apparatus 10 may for example be positioned adjacent belt 52 near the charge corotron 60 as shown.

Referring particulary to FIG. 6, where like numerals designate like parts, the bias output of power source 72 to sleeve 70 of developer rolls 67 is there regulated in response to changes in photoreceptor sensitivity as measured across current leakage apparatus 10 through control circuit 96. In circuit 96, meter 22 of FIG. 4 is replaced by operational amplifier 93, lead 18 being coupled to one input of amplifier 93. Amplifier 93 is employed as a conventional current to voltage converter recognizable to those skilled in the art of operational amplifiers. The other input of amplifier 93 may be grounded through lead 94.

The analog type output signal of amplifier 93 appearing in line 95, the value of which represents the change in sensitivity of photoreceptor belt 52 in response to changes in temperature, controls the voltage bias output of power source 72 to magnetic brush sleeves 70 through suitable signal responsive voltage control means (not shown).

It will be understood that while the bias supply to magnetic brush sleeves 70 is illustrated as being regulated in response to changes in sensitivity of photoreceptor belt 52 as responded to by current leakage apparatus 10, other components such as charge corotron 60 may be regulated concurrently or in the alternative.

While the invention has been described with reference to the structure disclosed, it is not confined to the details set forth, but is intended to cover such modifications or changes as may come within the scope of the following claims.

What is claimed is:

1. In a xerographic type reproduction machine including a housing with a movable photoreceptor together with process means to produce copies xerographically therewithin, said process means including charging means to place a uniform charge on said photoreceptor, exposure means for producing a latent electrostatic image of the original being copied, and developing means to develop the latent electrostatic image produced on said photoreceptor, said developing means including at least one biasable developer element, the combination of:

a. a test device disposed within said housing, said device comprising a miniature photoreceptor;

b. means for placing a preset voltage across said device; and c. control means for regulating voltage input to at least one of said charging means and said developer element in response to changes in current through said device, said current changes being produced by temperature variations within said machine housing.

2. In the method of controlling voltage to at least one component of a xerographic type reproduction machine, said machine including a housing having a light tight cavity with a photoreceptor member in said cavity, the steps consisting of:

a. positioning a photoreceptor segment representative of said photoreceptor member in said cavity where said segment is shielded from light;

b. placing a preset voltage across said segment; and c. regulating the voltage input to said one reproduction machine component in response to current flow through said segment, said current flow being produced by temperature variations within said machine housing.

3. The method according to claim 2 including the step of regulating the voltage bias used in developing the electrostatic images created on said photoreceptor member in response to current flow through said segment.

4. The method according to claim 2 including the step of regulating the voltage applied to the charge corotron for said photoreceptor member in response to current flow through said segment.

5. A method for measuring dark current leakage of a class of photoreceptors adapted for use in xerographic copying apparatus, the steps consisting of:

a. construction a test device by removing a small segment from at least one of the photoreceptors comprising said photoreceptor class, and attaching electrical leads to each of the photosensitive surface and substrate of said removed segment;

b. placing said test device in a dark environment representative of the photoreceptor operating environment;

c. placing a preset test voltage across the leads of said device; and d. measuring current leakage through said device for different temperature conditions to determine dark current leakage characteristics of said photoreceptor class.

* * * * *

UNITED STATES PATENT OFFICE

CERTIFICATE OF CORRECTION

PATENT NO. : 4,021,112

DATED : May 3, 1977

INVENTOR(S) : Charles D. Wilson

It is certified that error appears in the above-identified patent and that said Letters Patent are hereby corrected as shown below:

In Claim 5, Column 6, line 29, change "construction" to --constructing--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*